US005131230A

United States Patent [19]

Barton et al.

[11] Patent Number: 5,131,230

[45] Date of Patent: Jul. 21, 1992

[54] SYSTEM FOR PROVIDING EARLY WARNING OF POTENTIAL WATER INDUCTION EVENTS AND ENABLING RAPID STEAM TURBINE RESTARTS

[75] Inventors: Serge P. Barton, Oviedo; Peter G. Smith, Winter Park, both of Fla.

[73] Assignee: Westinghouse Electric Corp., Pittsburgh, Pa.

[21] Appl. No.: 716,180

[22] Filed: Jun. 17, 1991

[51] Int. Cl.[5] ..... F01K 13/02

[52] U.S. Cl. ..... 60/646; 60/657

[58] Field of Search ..... 60/646, 657

[56] References Cited

U.S. PATENT DOCUMENTS 4,584,836 4/1986 McClelland .
4,787,408 11/1988 Twerdochlib .
4,840,063 6/1989 Twerdochlib .
4,870,859 10/1989 Twerdochlib .

*Primary Examiner*—Allen M. Ostrager

[57] ABSTRACT

A steam turbine monitoring and control system for a steam turbine having a base, a cover and interfacing plant piping system with plural feed water heaters and fluid tanks, includes a plurality of water detectors located in the interfacing plant piping system, for detecting the presence of water or cool fluid, a plurality of heater blankets covering the steam turbine, temperature detector means, coupled to the base and cover of the steam turbine, for detecting temperature differentials between the base and the cover, a water detector controller coupled to the plurality of water detectors and the temperature detector means; and monitor/alarm means, coupled to the water blanket power source, the plurality of heater blankets, the temperature detector means, and the plurality of water detectors, for indicating a condition of potential water induction when water or cool fluid is detected at any one of the plurality of water detectors, and for switching on the heater blankets to maintain absolute and relative temperatures between the cover and base within prescribed limits when the turbine is off-line.

8 Claims, 3 Drawing Sheets

SYSTEM FOR PROVIDING EARLY WARNING OF POTENTIAL WATER INDUCTION EVENTS AND ENABLING RAPID STEAM TURBINE RESTARTS

BACKGROUND OF THE INVENTION

1. Field of the Invention

The present invention relates generally to steam turbines and, more specifically, for providing early warning of potential turbine water induction events and to a system maintaining clearances between rotating and stationary parts thereby enabling steam turbine restarts. The early warning system enables utilities to take timely corrective action to avoid such water induction.

2. Description of the Related Art

Turbine heating blankets have been used to alleviate the potential for damage to turbine components caused by significant temperature differentials, to maintain the turbine unit on warm standby for rapid start-up, and to reduce start-up time and thus improve turbine availability.

A steam turbine restart temperature maintenance system employing heating blankets is described in U.S Pat. No. 4,584,836, issued to McClelland. A steam turbine cover or outer casing is enveloped by a plurality of blankets, each sized and shaped to fit the contour of the turbine and held in place by bolting. The blankets include a plurality of "heater elements" which have a conductive core and a ceramic sheath. The elements are held between a thin corrugated metal layer overlaid on the outer casing of the turbine and two plies of ceramic fiber insulator. When the elements are energized by a power source, heat is transferred to the turbine.

The system described above minimizes cover/base temperature differentials arising from gaseous convection off-line, thus reducing the potential for thermal cylinder distortion including cylinder arching. Cylinder arching can change clearances and can lead to serious rubs between rotating and stationary parts in the blade path, depending on the magnitude of cover/base differential and the turbine configuration. The system has also been found to be well suited to maintaining minimum turbine temperatures during shut down.

The maintenance of proper clearances between stationary and rotating parts is crucial to the prevention of major wrecks or rub damage to seals.

Water inductions pose a major threat to steam turbines since they have the potential for causing substantial thermal stresses and distortions leading to damage to stationary and rotating parts of the turbine. More gradual temperature changes occurring from convection cooling following a turbine trip while the turbine is off-line and on turning gear, can also cause physical damage. Temperature differences between the cover and base of a turbine casing cause thermal deformation and can lead to blade path seal rubs, permanent distortion or more severe damage depending on the magnitude of the temperature differences.

Many turbine water induction incidents develop as a result of a relatively slow accumulation of water (or cool fluid) in interface steam pipes and vessels.

A need exists for an early warning of the abnormal presence of water or cool fluid and abnormal or unacceptable cover/base temperature differences.

SUMMARY OF THE INVENTION

An object of the present invention is to detect abnormal cover to base temperature differences and to provide means for correcting excessive off-line temperature differences.

Another object of the present invention is to provide a monitoring and control system capable of maintaining temperatures of the turbine rotor above a preset minimum temperature in order to enable quick turbine restart.

Another object of the present invention is to provide a monitoring system for a steam turbine which is capable of producing an early warning of the abnormal presence of water or cool fluid, so that operators of the power plant can take timely corrective action to prevent water induction events.

These and other objects of the invention are met by providing a monitoring and control system for a steam turbine having a base, a cover, rotating parts interfacing plant piping system which incorporate turbine inlet and exhaust pipe drain lines, extraction lines, valves and feedwater heaters and other fluid containing tanks, the monitoring and control system including a plurality of water detectors located in the interfacing plant piping and fluid tanks system for detecting the presence of water or cool fluid, a plurality of heater blankets covering the steam turbine, a plurality of temperature detector means coupled to the base and cover, a detector controller coupled to the plurality of water detectors, and a monitor alarm chassis coupled to the detector controller and the plurality of water detectors and the plurality of heater blankets, the temperature detector means, and the plurality of water detectors, for indicating a condition for potential water induction when water or cool fluid is detected at any one of the plurality of water detectors and for switching on the heater blankets to maintain absolute and relative temperatures between the cover and base within prescribed limits.

These and other features are advantages of the monitoring and control system of the present invention will become apparent with reference to the following detailed description and drawings.

DETAILED DESCRIPTION OF THE PREFERRED EMBODIMENTS

Figure 1:
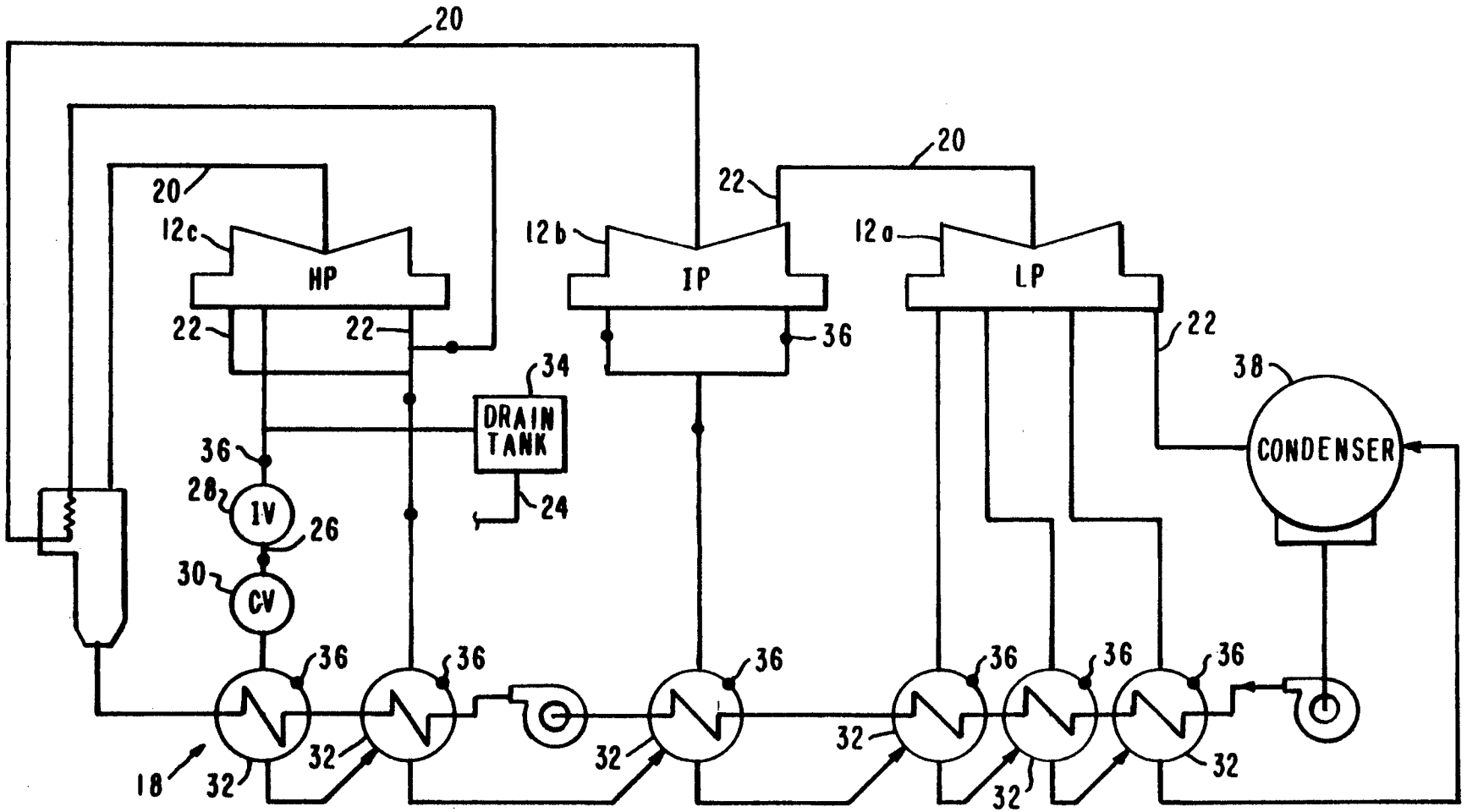
FIG. 1 is a schematic view of a steam turbine and an interfacing plant piping system showing examples of preferred locations of water detectors which are part of the monitoring and control system of the present invention.
Figure 2:
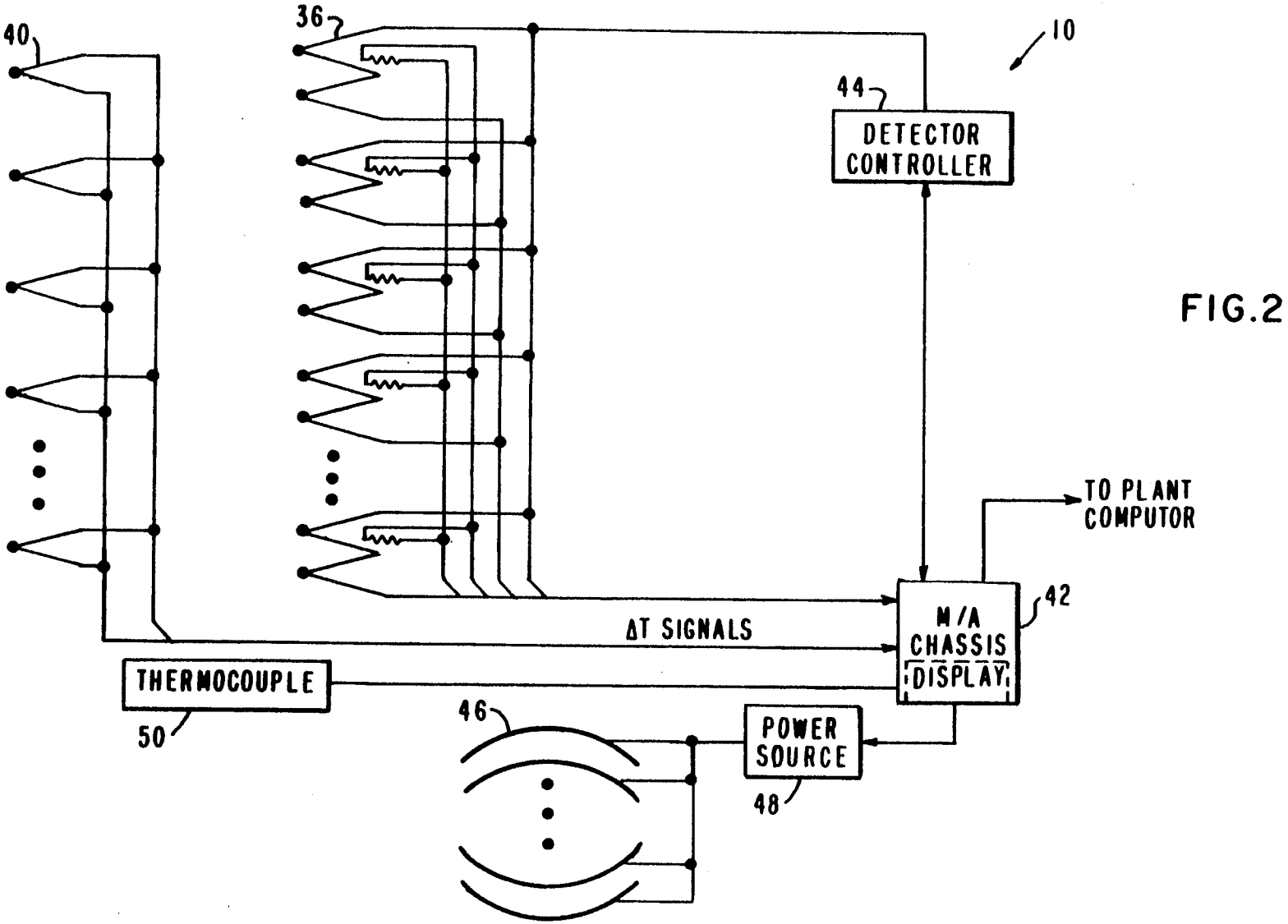
FIG. 2 is a schematic diagram showing the monitoring and control system according to the present invention.
Figure 3:
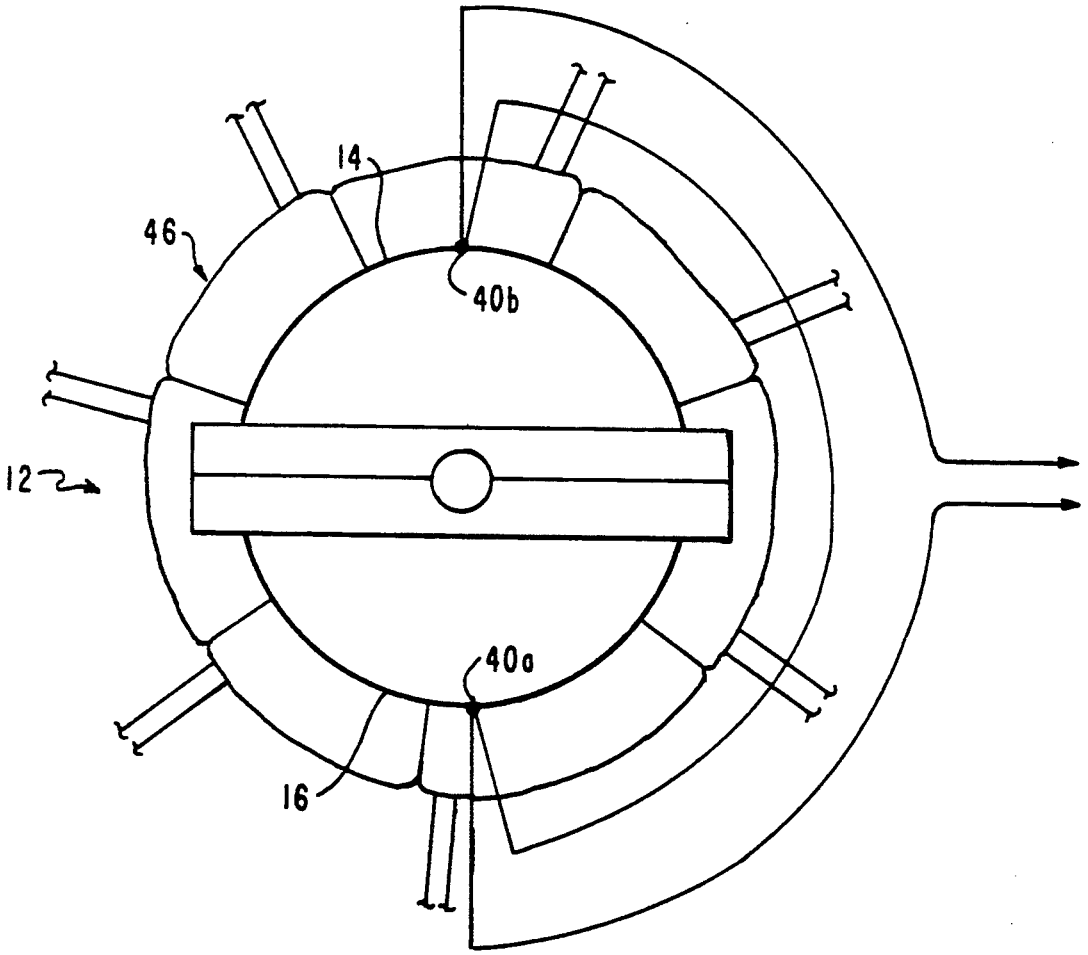
FIG. 3 is a schematic view showing a steam turbine with heater blankets and a single pair of thermocouples differentially connected across the cover and the base.

Referring now to FIGS. 1–3, the present monitoring and control system 10 is for a steam turbine, generally referred to by the numeral 12 in FIG. 3. It is understood in the industry that a power plant turbine may consist of multiple different sections, each consisting of one, two, or three separate turbines, such as is illustrated in FIG. 1: A low pressure (LP) section 12*a*, an intermediate pressure (IP) section 12*b*, and a high pressure (HP) section 12*c*. All sections of a stream turbine are interconnected to produce a single rotary output. The steam turbine 12 has a cover 14 and a base 16.

An interfacing plant piping system is generally referred to by the numeral 18. This system includes turbine inlet pipes 20 and exhaust pipes 22, drain lines 24, extraction lines 26 (anything going to the feed water heaters), valves such as isolation valves 28 and non-return or check valves 30, feed water heaters (HTR) 32, and other fluid containing tanks such as drain tank 34. Also schematically illustrated in the system is a condenser 38. A plurality of water detectors 36 are located in the interfacing plant piping system 18 for detecting the presence of water or cool fluid. An example of preferred locations includes a water detector 36 located at the feed water heaters 32, which are normally between 20 and 200 feet from the turbine 12. These detectors 36 are sited at remote points outside the turbine to indicate the abnormal presence of water or cool fluid. These detectors are described in a patent application by M. Twerdochlib, assigned to Westinghouse Electric Corporation and having a Ser. No. of 07/196,706 and a filing date of May 20, 1988 now U.S. Pat. No. 4,859,076. This application is incorporated herein by reference. Since many turbine water induction incidents develop as a result of a relatively slow accumulation of water (or cool fluid) in interface steam pipes and vessels, the present invention provides an early warning capability for detecting the abnormal presence of cool fluid in piping systems or vessels. Early detection enables operators to isolate and dispose of this fluid, by releasing the fluid from appropriate piping in the system 18. The release of this fluid avoids turbine damage caused by thermal stresses, thermal distortion of parts, and loss of clearances between moving parts which result from the cool fluid. The water detectors 24 respond to differences in heat transfer properties between steam and water. This capability is effective when the turbine is on or off-line.

A plurality of differentially coupled thermocouple pairs 40 are coupled to the base 16 and the cover 14 of the steam turbine 12 for detecting temperature differentials between the base and the cover. Thermocouples are per se known and used in the industry to provide temperature differential measurement. One thermocouple 40*a* of each pair 40 is coupled to the base and the other 40*b* is coupled to the cover. The thermocouples themselves are commercially available from a wide variety of sources, and the same or different models may be used as those which were described in U.S. Pat. No. 4,584,836, which is incorporated herein by reference.

The thermocouples 40 are paired as shown in FIG. 3 as a thermocouple pair 40*a* and 40*b*. These two thermocouples are coupled together to provide a typical differentially connected pair of thermocouples that measure cover to base temperature differentials. The thermocouples are located to measure internal temperatures in the turbine structure. Preferably, multiple pairs would be provided to indicate temperature differentials throughout the turbine. A signal indicative of the differential temperature is output from each thermocouple pair 40 and received by the monitor/alarm chassis (M/A) 42.

A detector controller (DC) 44 provides regulated power for the water detectors 36 and controls their operation. Each water detector 36 includes a pair of differentially coupled thermocouples and a heater. The heater is powered by the detector controller and thus provides a power source for the water detectors. The water detectors 36 operate on the principal of thermal gradients, whereby a heated pipe produces a given thermal gradient in the absence of water and a different thermal gradient when water or other cool fluid is present. The changes in thermal gradient are picked up by placing the differentially coupled thermocouples of each pair in a predetermined spatial relationship to their corresponding heater. The details of this water detector are to be found in the aforementioned patent application of Michael Twerdochlib which has been incorporated by reference herein. The detector controller 44 is linked to the monitors/alarm (M/A) chassis 42 can have an output to the plant computer, as indicated in the schematic illustration of FIG. 2, and receives differential temperature ($\Delta T$) signals from the thermocouple pairs of each water detector 36. Based on these signals, the monitor/alarm chassis 42 determines whether water or cold fluid is present based on a comparison of stored values. A display associated with the M/A 42 such as an LED indicator light can be used to display an alarm condition indicating that a water induction event is eminent. The M/A 42 is also capable of performing self checks in order to determine whether or not any one or both of the thermocouples of each pair associated with each water detector 36 is not functioning.

A plurality of heater blankets 46 are coupled to a separate power source 48 which is switched on by the monitors/alarm chassis 42 when the differential temperature is detected by the thermocouples 40 warrant increasing the temperature of either the base or cover components of the turbine, or sections of either the cover or base. Thus, the monitor/alarm chassis 42 switches on the heater blankets 6 to maintain absolute and/or relative temperatures between the covering base within prescribed limits so as to enable quick start of the turbine. $\Delta T$ signals from the thermocouples 40 are thus supplied to the M/A 42 which determines, based on a comparison to stored values, whether or not the blankets 46 should be switched on.

It is also possible to configure the system so that the monitor/alarm chassis 42 provides only a signal indicative of a differential temperature status of the turbine in the control room of the plant. This can be done by connecting the monitor/alarm chassis to the plant computer. Thus, operators of the plant monitoring display devices can activate the blankets when the displays indicate that temperature differentials have reached an actionable level. Thus, in another embodiment of the invention, the monitor/alarm chassis 42 can simply monitor the status of the differential temperatures and provide an indication of what the differential temperatures are so that the heater blankets 46 can be manually activated.

The monitor/alarm chassis 42 may be located in the control room and may be provided with a display and an audible alarm for indicating visually or audibly a condition of potential water induction when water or cool fluid is detected at any one of the water detectors 36. The location of the water detectors is indicated at that display so that the plant operators can take corrective action to remove the water or cool fluid.

From the above, it should be clear that the detector controller 44 is connected to the water detectors 36 and to the monitor/alarm chassis, whereas the monitor/alarm chassis is connected to the water detectors and to the detector controller 44, and the cover-to-base thermocouples and to the heater blanket power source. The function of the detector controller is to provide regulated power to the water detectors, and to control them and to communicate status to the monitor/alarm chassis. The function of the monitor/alarm chassis is to detect water and determine temperature differentials and to provide operator interface by having display means, either visual or audible or both. The monitor/alarm chassis can also indicate the numerical temperature or differential temperature on a panel meter incorporated in the monitor. It is also possible to provide a single thermocouple 50 on the base of the turbine to provide an absolute temperature reading.

Numerous modifications and adaptations of the present invention will be apparent to those so skilled in the art and thus, it is intended by the following claims to cover all such modifications and adaptations which fall in the true spirit and scope of the invention.

What is claimed is:

1. A steam turbine monitoring and control system for a steam turbine having a base, a rotor, a cover and an interfacing plant piping system including turbine inlet pipes and exhaust pipes, drain lines, extraction lines, valves such as isolation valves and non-return or check valves and feed water heaters, comprising:

a plurality of water detectors located in the interfacing plant piping system, for detecting the presence of water or cool fluid;

a plurality of heater blankets covering the cover and base of the steam turbine;

temperature detector means, coupled to the base and cover of the steam turbine, for detecting temperature differentials between the base and the cover;

a detector controller coupled to the plurality of water detectors; and monitor/alarm means coupled to the detector controller, the plurality of heater blankets, the temperature detector means, the plurality of water detectors, for indicating a condition of potential water induction when water or cool fluid is detected at any one of the plurality of water detectors, and for switching on the heater blankets to maintain relative temperatures between the cover and base within prescribed limits.

2. A monitoring and control system as recited in claim 1, wherein the temperature detector means comprises a pair of thermocouples differentially coupled to each other and disposed respectively on the cover and base for producing a differential temperature signal indicative of a relative temperature difference between the cover and base, said differential temperature signal being fed to the monitor/alarm means.

3. A monitoring and control system as claimed in claim 1, further comprising means for detecting absolute temperatures of the cover and base.

4. A monitoring and control system as claimed in claim 3, wherein the monitor/alarm means automatically switches on the heating blankets when the absolute temperatures of the base or cover falls below prescribed levels.

5. A monitoring and control system as claimed in claim 1, wherein the monitor/alarm means switches on selected zones of the plurality of heater blankets to reduce temperature differences between the cover and base.

6. A monitoring and control method for a steam turbine having a base, a cover, and an interfacing plant piping system including turbine inlet pipes and exhaust pipes, drain lines, extraction lines, valves such as isolation valves and non-return or check valves and feed water heaters, comprising:

covering the steam turbine with a plurality of heater blankets;

detecting the presence of water or cool fluid with a plurality of water detectors located in the interfacing plant piping system;

detecting temperature differentials indicative of water between the base and the cover with temperature detector means; and indicating a condition of potential water induction when water or cool fluid is detected at any one of the plurality of water detectors or actual water conduction in the turbine by the cover to base thermocouples, because temperature differences exceed a predetermined value.

7. A monitoring and control method as recited in claim 6, further comprising detecting absolute temperature of the cover and base.

8. A steam turbine monitoring and control system for a steam turbine having a base, a cover and including turbine inlet pipes and exhaust pipes, drain lines, extraction lines, valves such as isolation valves and non-return or check valves and feed water heaters, comprising:

a plurality of water detectors located in the interfacing plant piping system, for detecting the presence of water or cool fluid;

a plurality of heater blankets covering the steam turbine;

temperature detector means, coupled to the base and cover of the steam turbine, for detecting temperature differentials between the base and the cover;

a power source coupled to the plurality of water detectors and temperature detector means; and monitor/control means, coupled to the power source, the plurality of heater blankets, the temperature detector means, and the plurality of water detectors, for indicating a condition of potential water induction when water or cool fluid is detected at any one of the plurality of water detectors, or actual water induction when detected by the thermocouples.

* * * * *